United States Patent [19]

Sudweeks et al.

[11] 4,216,040

[45] Aug. 5, 1980

[54] EMULSION BLASTING COMPOSITION

[75] Inventors: Walter B. Sudweeks, Orem; Harvey A. Jessop, Lehi, both of Utah

[73] Assignee: IRECO Chemicals, Salt Lake City, Utah

[21] Appl. No.: 4,958

[22] Filed: Jan. 19, 1979

Related U.S. Application Data

[63] Continuation-in-part of Ser. No. 883,077, Mar. 3, 1978, Pat. No. 4,141,767.

[51] Int. Cl.[2] ..... C06B 45/02

[52] U.S. Cl. ..... 149/21; 149/41; 149/43; 149/44; 149/46; 149/60; 149/61; 149/71

[58] Field of Search ..... 149/21, 41, 43, 44, 149/46, 60, 61, 71

[56] References Cited

U.S. PATENT DOCUMENTS

| | | | |
|---|---|---|---|
| 4,104,092 | 8/1978 | Mullay | 149/2 |
| 4,110,134 | 8/1978 | Wade | 149/2 |

*Primary Examiner*—Stephen J. Lechert, Jr.
*Attorney, Agent, or Firm*—Robert A. Bingham

[57] ABSTRACT

The invention relates to water-in-oil emulsion blasting agents having a discontinuous aqueous phase, a continuous oil or water-immiscible liquid organic phase, and an emulsifier having an unsaturated hydrocarbon chain for its lipophilic portion.

9 Claims, No Drawings

EMULSION BLASTING COMPOSITION

This is a continuation-in-part to application Ser. No. 883,077, filed Mar. 3, 1978, now U.S. Pat. No. 4,141,767.

The present invention relates to improved explosive compositions. More particularly, the invention relates to water-in-oil emulsion blasting compositions having a discontinuous aqueous phase and a continuous oil or water-immiscible liquid organic phase. The compositions comprise (a) discrete droplets of an aqueous solution of inorganic oxidizer salt(s), (b) a water-immiscible liquid organic fuel forming a continuous phase throughout which the droplets are dispersed, and (c) an emulsifier that forms an emulsion of the oxidizer salt solution droplets throughout the continuous liquid organic phase. Preferably, the compositions contain a uniformly dispersed density reducing agent such as small glass or plastic spheres or microballoons, which increase composition sensitivity under relatively high pressures. The emulsifier of the present invention is cationic and has an unsaturated hydrocarbon chain for its lipophilic portion. Synergistic combinations of this emulsifier with particular fuels is another aspect of the present invention.

Aqueous blasting compositions or slurries generally have a continuous aqueous phase throughout which immiscible liquid hydrocarbon fuel droplets or solid ingredients may be dispersed. In contradistinction, the compositions of the present invention are termed "inverted phase" compositions due to the presence of the "water-in-oil" emulsion.

Inverted phase slurries or compositions are known in the art. See, for example, U.S. Pat. Nos. 4,110,134, 3,447,978; Re 28,060; 3,765,964; 3,770,522; 3,715,247; 3,212,945; 3,161,551; 3,376,176, 3,296,044; 3,164,503; and 3,232,019. Inverted phase slurries have certain distinct advantages over conventional slurry explosives, which themselves have become commercially popular due to their low cost, safety, fluidity (at least at time of formulation), and water resistability. Aqueous explosive compositions generally contain thickening agents for thickening the continuous aqueous phase so as to provide water resistance and to prevent segregation of solid, dispersed fuel and sensitizer ingredients. Thickening agents are also necessary to prevent coalescence or migration of dispersed immiscible liquid fuel droplets and sensitizing gas bubbles, if present. Not only are such thickening agents expensive, but also they tend to degrade with time, particularly under harsh environments, thereby causing the composition to lose its stability and consequently its homogeneity, which is essential to a composition's sensitivity and thus detonability. A major advantage of inverted phase slurries is that they require no thickeners and cross-linkers. In fact, inverted phase slurries are very water-resistant without thickeners.

Other advantages of inverted phase slurries and particularly of the slurries of the present invention are manifest:

1. The inverted phase compositions of the present invention are relatively sensitive, i.e., they detonate in small diameters at low temperatures with high detonation velocities without requiring expensive metallic particulate or other energetic sensitizers or dangerous molecular explosive sensitizers. The sensitivity of the compositions is at least partly attributable to the intimate mixture of oxidizer and fuel occasioned by the existence of a fine dispersion of small oxidizer solution droplets that collectively have a high surface area and that are coated by a thin film of liquid hydrocarbon fuel. The compositions can be made either cap-sensitive or non-cap-sensitive as desired.
2. The sensitivity of the inverted phase compositions is relatively independent of temperature. This is at least partly attributable to the fact that desensitizing crystal growth of any oxidizer salt crystals that may crystallize upon cooling of the composition is limited by the size of the salt solution droplets. Further, the compositions can remain pliable after cooling, and this is usually not a property of conventional slurries.
3. The compositions allow the effective use of relatively inexpensive liquid hydrocarbon fuels.
4. Additional advantages include resistance to dead pressing, reduced channel effect, resistance to low-temperature desensitivity, and ease of detonability at high densities.

It has been found that cationic emulsifiers having unsaturated hydrocarbon chains for their lipophilic portions are superior to those having saturated hydrocarbon chains for such portions. As is shown in the comparative examples below, blasting compositions employing unsaturated cationic emulsifiers are found to be more stable and to have a higher sensitivity than compositions employing the saturated form.

It is also found that certain combinations of unsaturated cationic emulsifiers with particular liquid organic fuels are especially effective for providing stability and sensitivity to the blasting compositions.

SUMMARY OF THE INVENTION

The composition of the invention comprises an inverted phase or water-in-oil blasting composition having a water-immiscible liquid organic fuel as a continuous phase, an emulsified aqueous inorganic oxidizer salt solution as a discontinuous phase, and an organic cationic emulsifier having a hydrophilic portion and a lipophilic portion, wherein the lipophilc portion is an unsaturated hydrocarbon chain.

DETAILED DESCRIPTION OF THE INVENTION

The oxidizer salt or salts are selected from the group consisting of ammonium and alkali metal nitrates and perchlorates and ammonium and alkaline earth metal nitrates and perchlorates. Preferably, the oxidizer salt is ammonium nitrate (AN) alone or in combination with calcium nitrate (CN) or sodium nitrate (SN). However, potassium nitrate as well as perchlorates can be used. The amount of oxidizer salt employed is generally from about 45% to about 94% by weight of the total composition, and preferably from about 60% to about 86%.

Preferably all of the oxidizer salt is dissolved in the aqueous salt solution during formulation of the composition. However, after formulation and cooling to ambient temperature, some of the oxidizer salt may precipitate from the solution. Because the solution is present in the composition as small, discrete, dispersed droplets, the crystal size of any precipitated salts will be physically inhibited. This is advantageous because it allows for greater oxidizer-fuel intimacy, which is one of the major advantages of an inverted phase slurry. In fact, the unsaturated emulsifiers of the present invention are found to inhibit any appreciable crystal growth and are far superior in this respect than their saturated equivalents. In addition to inhibiting crystal size physically, the fatty acid amine emulsifier of the present invention also functions as a crystal habit modifier to control and limit the growth of crystals. Thus crystal growth is inhibited by both the emulsified nature of the composition and the presence of a crystal habit modifier.

Water is employed in an amount of from about 2% to about 30% by weight, based on the total composition. It is preferably employed in amount of from about 5% to about 20%, and more preferably from about 8% to about 16%. Water-miscible organic liquids can partially replace water as a solvent for the salts, and such liquids also function as a fuel for the composition. Moreover, certain organic liquids act as freezing point depressants and reduce the fudge point of the oxidizer salts in solution. This can enhance sensitivity and pliability at low temperatures. Miscible liquid fuels can include alcohols such as methyl alcohol, glycols such as ethylene glycols, amides such as formamide, and analogous nitrogen-containing liquids. As is well known in the art, the amount of total liquid used will vary according to the fudge point of the salt solution and the desired physical properties.

The immiscible liquid organic fuel forming the continuous phase of the composition is present in an amount of from about 1% to about 10%, and preferably in an amount of from about 3% to about 7%. The actual amount used can be varied depending upon the particular immiscible fuel(s) and supplemental fuel(s) (if any) used. When fuel oil or mineral oil are used as the sole fuel, they are preferably used in amount of from about 4% to about 6% by weight. The immiscible organic fuels can be aliphatic, alicyclic, and/or aromatic and can be saturated and/or unsaturated, so long as they are liquid at the formulation temperature. Preferred fuels include mineral oil, waxes, paraffin oils, benzene, toluene, xylenes, and mixtures of liquid hydrocarbons generally referred to as petroleum distillates such as gasoline, kerosene and diesel fuels. Particularly preferred liquid fuels are mineral oil and No. 2 fuel oil. Tall oil, fatty acids and derivatives, and aliphatic and aromatic nitrocompounds also can be used. Mixtures of any of the above fuels can be used. It is particularly advantageous to combine specific fuels with specific emulsifiers as described below.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed above. These additional solid and/or liquid fuels can be added generally in amount ranging up to 15% by weight. If desired, undissolved oxidizer salt can be added to the solution along with any solid or liquid fuels.

The emulsifer of the present invention is cationic and has both hydrophilic and lipophilic portions. The lipophilic portion is an unsaturated hydrocarbon chain. The emulsifier can be a fatty acid amine or ammonium salt having a chain length of from 14 to 22 carbon atoms, and more preferably, from 16 to 18. The fatty acid amine emulsifiers preferably are derived from tallow (16 to 18 carbon atoms). In addition to functioning as a water-in-oil emulsifier, the fatty acid amine also functions as a crystal habit modifier for the oxidizer salt in solution. Another example of an emulsifier is a substituted oxazoline of the formula:

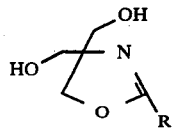

wherein R represents an unsaturated hydrocarbon chain derived from an unsaturated fatty acid, preferably oleic acid. The emulsifier is employed in an amount of from about 0.2% to about 5% by weight. It preferably is employed in an amount of from about 1% to about 3%.

A synergism results when particular emulsifiers are combined with particular liquid organic fuels. For example, 2-(8-heptadecenyl)-4,4'-bis(hydroxylmethyl)-2-oxazoline in combination with refined mineral oil is a very effective emulsifier and liquid organic fuel system. As is shown in the examples which follow, this combination produces blasting compositions which are No. 2 cap-sensitive, which have critical diameters equal to or less than 13 mm, which have low temperature sensitivity (No. 4 cap-sensitive at −40° C.), which have measured stability lasting several months, and which require only relatively small amounts of emulsifier. This emulsifier and this fuel have been found to be less effective in different combinations.

The compositions of the present invention are reduced from their natural densities of near 1.5 gm/cc or higher to a lower density within the range of from about 0.9 to about 1.4 gm/cc. As is well known in the art, density reduction greatly enhances sensitivity, particularly if such reduction is accomplished through the dispersion of fine gas bubbles throughout the composition. Such dispersion can be accomplished in several ways. Gas bubbles can be entrained into the composition during mechanical mixing of the various ingredients. A density reducing agent can be added to lower the density by a chemical means. A small amount (0.01% to about 0.2% or more) of a gassing agent such as sodium nitrite, which decomposes chemically in the composition to produce gas bubbles, can be employed to reduce density. Small hollow particles such as glass spheres, styrofoam beads, and plastic microballoons can be employed as the density reducing agent, and this is the preferred density reducing means of the present invention. The use of hollow particles is particularly advantageous where the compositions will be subjected to relatively high pressures, such as 20 psig or more. Because such particles are incompressible prior to detonation, they maintain the composition's low density, which is necessary for adequate sensitization and thus detonability, under high pressures. Two or more of the above-described common gassing means may be employed simultaneously.

One of the main advantages of an inverted phase slurry over a continuous aqueous phase slurry is, as mentioned previously, that thickening and cross-linking agents are not necessary for stability and water-resistancy. However, such agents can be added if desired. The aqueous solution of the composition can be rendered viscous by the addition of one or more thickening agents of the type and in the amount commonly employed in the art. Such thickening agents include galactomannin (preferably guar gums); guar gum of reduced molecular weight such as described in U.S. Pat. No.

3,890,171; polyacrylamide and analogous synthetic thickeners; flours; and starches. Biopolymer gums, such as those described in U.S. Pat. No. 3,788,909, also can be used. Thickening agents other than flours and starches are generally used in amounts ranging from about 0.05% to about 0.5%, and flours and starches may be employed in much greater amounts, up to about 10%, in which case they also function importantly as fuels. Cross-linking agents for cross-linking the thickening agents also are well known in the art. Such agents are usually added in trace amounts and usually comprise metal ions such as dichromate or antimony ions. The liquid organic, which forms the continuous phase of the composition, also can be thickened, if desired, by use of a thickening agent which functions in an organic liquid. Such thickening agents are well known in the art.

The compositions of the present invention are formulated by preferably first dissolving the oxidizer salt(s) in the water (or aqueous solution of water and miscible liquid fuel) at an elevated temperature of from about 25° C. to about 110° C., depending upon the fudge point of the salt solution. The emulsifier and the immiscible liquid organic fuel then are added to the aqueous solution, preferably at the same elevated temperature as the salt solution, and the resulting mixture is stirred with sufficient vigor to invert the phases and produce an emulsion of the aqueous solution in a continuous liquid hydrocarbon fuel phase. Usually, this can be accomplished essentially instantaneously with rapid stirring. (The compositions also can be prepared by adding the aqueous solution to the liquid organic). For a given composition, the amount of agitation necessary to invert the phases can be established by routine experimentation. Stirring should be continued until the formulation is uniform, and then solid ingredients such as microballoons or solid fuel, if any, can be added and stirred throughout the formulation. The examples below provide specific illustrations of degrees of agitation.

It has been found to be particularly advantageous to predissolve the emulsifier in the liquid organic fuel prior to adding the organic fuel to the aqueous solution. Preferably, the fuel and predissolved emulsifier are added to the aqueous solution at about the temperature of the solution. This method allows the emulsion to form quickly and with little agitation. Considerably greater agitation is required if the emulsifier is added to the aqueous solution at or before the time of addition of the liquid organic fuel.

Sensitivity and stability of the compositions may be improved by passing them through a high-shear system to break the dispersed phase into even smaller droplets. This additional processing through a colloid mill has shown an improvement in rheology and performance. Detonation results before and after further processing through a colloid mill are shown in Table I. The mill had a 15 horsepower electric motor running at 3450 rpm and had a variable radial clearance range of 0.25 to 6 mm. The glass microballoons were mixed in after the refinement step.

In further illustration of the present invention, Examples A, B and C of Table II below contain formulations and detonation results of preferred compositions of the present invention. These three examples were prepared according to the procedure described above, including use of the colloid mill. They illustrate the effectiveness of the mineral oil and substituted oxazoline combination described previously. Example D is equivalent to C except that the emulsifier in D is in the saturated form. The detonation results show that the unsaturated emulsifier is vastly superior.

In Table III, Examples A, B and L were prepared according to the procedure described above, except that the emulsifier was not predissolved in the liquid organic. In Examples C, D, E and F–K, the emulsifier was predissolved in the liquid organic. These examples illustrate the use of a fatty acid amine emulsifier in compositions that are not cap-sensitive. Generally, the compositions were prepared in 10 kg batches (approximately 10 liters) in about a 20 liter container and were mixed and agitated by a 2 to 2.5 inch diameter propeller driven by a 2 hp pneumatic motor operating with a pressure source of about 90 to 100 psi. However, some of the compositions were prepared in about a 95 liter open kettle and were mixed by a 3 to 4 inch diameter propeller driven by the same pneumatic motor. The compositions were not passed through a colloid mill. The detonation results were obtained by detonating the compositions in the charge diameters indicated with pentolite boosters weighing from 5 gm to 40 gm or more. The results evidence relatively high sensitivity in small diameters at low temperature without the need for expensive metallic or self-explosive sensitizers.

Table IV is a comparison of detonation results at 5° C. between compositions employing a fatty acid amine emulsifier having a saturated lipophilic portion and essentially identical compositions employing the emulsifier in the unsaturated form. Although the difference is not dramatic, compositions A–D, employing the saturated emulsifier, had larger critical diameters and thus were less sensitive than compositions E–G, employing the unsaturated emulsifier of the present invention. All of the compositions were non-cap-sensitive to a No. 8 cap.

The amounts of emulsifier used in the compositions of Table IV were optimized to provide the desired viscosity. Two percent of the saturated emulsifier provided about the same viscosity as three percent of the unsaturated emulsifier.

Of more significance than the detonation results was the difference in physical properties of the Table IV compositions. Upon cooling, the saturated emulsifier compositions experienced considerably more oxidizer salt crystallization than the unsaturated emulsifier compositions. Such crystallization tends to desensitize and destablize the composition. At 5° C. or below, the saturated emulsifier compositions would crystallize quickly if stirred or kneaded and would form a solid mass. The unsaturated emulsifier compositions could take much more agitation before crystallization would occur, and even then, the crystals would not knit together. These differences in physical properties are reflected in Table IV in the storage results, which results indicate that the unsaturated emulsifier compositions are much more stable.

The compositions of the present invention can be packaged, such as in cylindrical sausage form, or can be directly loaded into a borehole for subsequent detonation. In addition, they can be repumped or extruded from a package or container into the borehole. Depending upon the ratio of aqueous and oil phases, the compositions are extrudable and/or pumpable with conventional equipment. However, the viscosity of the compositions may increase with time depending upon whether the dissolved oxidizer salts precipitate from solution and to what extent. A particular advantage is that the compositions, which can be formulated either on-site (such as in a mobile mixing and pumping truck) for immediate placement or in batch for subsequent placement, can be pumped into a water-containing borehole from the top of the borehole. With conventional slurries, pumping into water-containing boreholes generally is accomplished through a hose that is placed at the bottom of the borehole (with the nozzle below the water-slurry interface) and that is gradually withdrawn as the hole is filled in order to prevent water-slurry intermixture. Because of the inherent water-resistance of the compositions of the present invention, they can be loaded from the top of the borehole without fear of excessive water-slurry intermixture.

The low temperature, small diameter sensitivity and the inherent water-proofness of the compositions render them versatile and economically advantageous for most applications.

While the present invention has been described with reference to certain illustrative examples and preferred embodiments, various modifications will be apparent to those skilled in the art and any such modifications are intended to be within the scope of the invention as set forth in the appended claims.

TABLE I

| COMPOSITION INGREDIENTS (Parts by Weight) | | |
|---|---|---|
| AN | 67.6 | |
| SN | 13.5 | |
| $H_2O$ | 11.4 | |
| Emulsifier[a] | 1.0 | |
| Mineral Oil | 4.4 | |
| Glass microballoons | 2.1 | |
| Density (g/cc) | 1.24 | |
| Refinement: | Before | After |
| Detonation Results at 5° C.[b]: | | |
| 13 mm | F | 3.3 |
| 19 mm | 3.9 | 4.5 |
| 25 mm | | 4.9 |
| 32 mm | 5.1 | 4.7 |
| 38 mm | 5.1 | |
| Minimum booster (cap) (Detonate/Fail) | #5/#4 | #4/#3 |
| Detonation Results at −20° C. | | |

TABLE I-continued

| | | |
|---|---|---|
| after two weeks: | | |
| 32 mm | F | D |
| Minimum booster (cap) (Detonate/Fail) | —/#8 | #5/#4 |

KEY:
[a]2-(8-heptadecenyl)-4,4'-bis(hydroxylmethyl)-2-oxazoline (IMC Chemical Group "Alkaterge-T")
[b]The decimal number is detonation velocity in km/sec; F = failure, D = detonation

TABLE II

| COMPOSITION INGREDIENTS (Parts by Weight) | A | B | C | D |
|---|---|---|---|---|
| AN | 65.8 | 65.0 | 67.7 | 66.7 |
| SN | 13.2 | 13.0 | 13.5 | 13.2 |
| $H_2O$ | 11.1 | 11.0 | 11.5 | 11.3 |
| Emulsifier | 2.5[a] | 1[a] | 1.0[a] | 1.0[b] |
| Mineral Oil | 4.2 | 4.3 | 4.7 | 4.6 |
| Glass microballoons | 3.0 | 4.0 | 1.5 | 3.1 |
| Gassing agent[c] | 0.2 | — | — | — |
| Density (g/cc) | 1.05 | 1.04 | 1.25 | 1.05 |
| Detonation Results[d]: | | | | |
| 5° C. 13 mm | 3.8 | — | — | — |
| 19 mm | 4.1 | — | 4.2 | — |
| 25 mm | 4.2 | — | — | — |
| 28 mm | — | — | 4.9 | — |
| 32 mm | 4.5 | 4.5 | — | — |
| 50 mm | — | — | — | F |
| 64 mm | — | — | — | F |
| −20° C. 13 mm | 4.0 | — | — | — |
| 19 mm | 4.0 | — | — | — |
| 25 mm | 4.4 | — | — | — |
| 32 mm | 4.3 | — | — | — |
| −40° C. 32 mm | 4.2 | — | — | — |
| Minimum booster (cap) (Detonate/Fail) | | | | |
| 5° C. | #3/#2 | #2/— | #3/#2 | — |
| −20° C. | #3/#2 | #3/#2 | — | — |
| −40° C. | #4/#3 | — | — | — |
| Critical diameter (mm) | — | 13 | — | — |

KEY:
[a]Same as Table I
[b]2-heptadecyl-4,4'-bis(hydroxylmethyl)-2-oxazoline. (IMC Chemical Group "wax-TF-254-AA")
[c]Toluenesulfonyl hydrazide
[d]The decimal number is detonation velocity in km/sec. F = failure, the 50 mm charge failed with a 170 gm pentolite booster and the 64 mm charge failed with a 370 gm booster

TABLE III

| COMPOSITION INGREDIENTS (Parts by Weight) | A | B | C | D | E | F | G | H | I | J | K | L |
|---|---|---|---|---|---|---|---|---|---|---|---|---|
| (Key on next page) | | | | | | | | | | | | |
| AN | 60.0 | 51.5 | 40.0 | 30.0 | 35.2 | 38.0 | 38.0 | 38.0 | 38.0 | 40.0 | 38.0 | — |
| CN[a] | 30.0 | 20.0 | 40.0 | 50.0 | 37.0 | 40.0 | 40.0 | 40.0 | 40.0 | 40.0 | 40.0 | — |
| SN | — | — | — | — | — | — | — | — | — | — | — | 5.0 |
| SP[b] | — | — | — | — | — | — | — | — | — | — | — | 54.8 |
| $H_2O$ | — | 10.0 | 2.0 | 5.0 | 9.3 | 10.0 | 10.0 | 10.0 | 10.0 | 9.0 | 9.0 | 18.2 |
| Emulsifier | 2.0[d] | 2.0[d] | 2.0[d] | 1.5[d] | 1.7[d] | 3.0[d] | 3.0[d] | 3.0[d] | 3.0[d] | 5.9[d] | 2.5[d] | 1.0[d] |
| Liquid Organic | 3.0[e] | 2.5[e] | 3.0[d] | 2.5[e] | 2.8[e] | 2.0[e] | 5.5[f] | 5.5[g] | 5.5[h] | 4.0[e] | 4.0[e] | 3.0[e] |
| Density Reducing Agent | 1.5[i] | 4.0[j] | 4.0[j] | 0.5[i] | 4.0[j] | 0.3[k] | 4.0[i] | 4.0[j] | 4.0[j] | 2.0[i] | 2.0[i] | 3.0[j] |
| Liquid Extender | 10[l] | — | — | 10.0[m] | — | — | — | — | — | — | — | 15.0[n] |
| Other Fuel | — | — | 10.0[o] | — | 10.0[p] | 2.5[q] | — | — | — | — | 5.0[r] | — |
| Formulation Temp. °C. | 101 | 90 | 80 | 40 | 70 | 70 | 60 | 60 | 60 | 70 | 70 | 50 |
| Density (g/cc) at 5° C. | 1.21 | 1.26 | 1.28 | 1.41 | 1.27 | 1.10 | 1.29 | 1.26 | 1.26 | 1.19 | 1.22 | 1.30 |
| Detonation Results at 5° C.[c]: | | | | | | | | | | | | |
| 76mm (3") charge dia. | — | — | — | — | — | — | — | — | — | — | — | — |
| 63.5mm (2½") | — | — | — | — | — | — | — | D | 4.6 | D | D | — |
| 51mm (2") | — | — | 5.0 | 4.9 | — | — | 4.2 | 4.6 | 4.6 | 5.0 | 4.7 | — |
| 38mm (1½") | 5.1 | 4.4 | 4.6 | F | 3.8 | 5.0 | F | F | F | 4.5 | 4.5 | D |
| 25.4mm (1") | — | F | 4.3 | — | F | — | — | — | — | F | 4.2 | F |

TABLE III-continued

| COMPOSITION INGREDIENTS (Parts by Weight) | A | B | C | D | E | F | G | H | I | J | K | L |
|---|---|---|---|---|---|---|---|---|---|---|---|---|
| 19mm (¾") | — | — | F | — | — | — | — | — | — | — | F | — |

KEY:
[a]Fertilizer grade comprising 81:14:5 CN:$H_2O$:AN
[b]Sodium perchlorate
[c]The decimal number is detonation velocity in km/sec; F=failure, D=detonation
[d]Alkylammonium acetate, unsaturated molecules having a chain length of from 16 to 18 carbon atoms (Armak "Armac T") major component is unsaturated
[e]No. 2 fuel oil
[f]Benzene
[g]Toluene
[h]Xylene
[i]Plastic microballoons (Dow "Saran")
[j]Glass microballoons (3-M "E22X")
[k]Chemical foaming agent
[l]Formamide
[m]Methanol
[n]Ethylene glycol
[o]Sugar
[p]Aluminum particles
[q]Paraffin
[r]Sulfur

TABLE IV

| COMPOSITION (Parts by Weight) | | A | B | C | D | E | F | G |
|---|---|---|---|---|---|---|---|---|
| AN | | 38 | 38 | 38 | 38 | 37.8 | 37.5 | 38.2 |
| CN[a] | | 40 | 40 | 40 | 40 | 39.8 | 39.4 | 40.2 |
| $H_2O$ | | 10 | 10 | 10 | 10 | 9.9 | 9.8 | 10.1 |
| Emulsifier | | 2[b] | 2[b] | 2[b] | 2[b] | 3[c] | 3[c] | 3[c] |
| Fuel Oil | | 6 | 6 | 6 | 6 | 5.5 | 5.5 | 5.5 |
| Microballoons | | 4 | 4 | 4 | 4 | 4 | 5 | 3 |
| Density (g/cc) | | 1.21 | 1.23 | 1.22 | 1.22 | 1.22 | 1.17 | 1.28 |
| Critical Dia. (mm) (Detonate/Fail) | | 25/18 | 32/25 | 18/12 | 32/25 | 18/12 | 18/12 | 32/25 |
| Detonation Velocity (m/sec) in diameter given: | 18mm | — | — | — | — | — | 4180 | — |
| | 25mm | 4100 | — | 4700 | — | 4300 | — | — |
| | 28mm | — | — | — | — | — | — | — |
| | 32mm | — | 4850 | — | 4790 | — | — | 4770 |
| | 38mm | 4900 | — | — | — | — | 4740 | — |
| | 50mm | — | — | 5040 | — | — | — | — |
| Storage Results: Days storage/ detonation result | | | | | | | | |
| | 18mm | — | — | — | — | 36/4300 | — | — |
| | 25mm | — | — | — | — | — | — | — |
| | 32mm | — | — | — | — | — | — | — |
| | 38mm | — | — | 63/4030 | 45/fail | — | 300/4380 | — |
| | 50mm | 74/fail | 56/fail | — | — | — | — | — |
| | 65mm | 74/detonate | | — | — | — | — | — |

KEY:
[a]Fertilizer grade
[b]Same as "c" below except saturated (Armak "Armac HT")
[c]Same as "d" in Table III

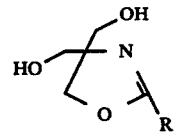

What is claimed is:

1. A water-in-oil emulsion blasting composition comprising a water-immiscible liquid organic fuel as a continuous phase, an emulsified aqueous inorganic oxidizer salt solution as a discontinuous phase, and from about 0.2% to about 5.0% by weight, based on the total composition, of an organic cationic emulsifier having a hydrophilic portion and a lipophilic portion, when the lipophilic portion is an unsaturated hydrocarbon chain.

2. A blasting composition according to claim 1 wherein the emulsifier comprises a substituted oxazoline of the formula:

wherein R represents an unsaturated hydrocarbon chain derived from an unsaturated fatty acid.

3. A blasting composition according to claim 2 wherein R is derived from oleic acid.

4. A blasting composition according to claim 1 wherein the liquid organic fuel is selected from the group consisting of mineral oil, benzene, toluene, xylene, and petroleum distillates such as gasoline, kerosene, and diesel fuels.

5. A blasting composition according to claim 3 wherein the liquid organic fuel is mineral oil.

6. A blasting composition according to claim 1 containing a density reducing agent in amount sufficient to reduce the density of the composition to within the range of from about 0.9 to about 1.4 gm/cc.

7. A blasting composition according to claim 6 wherein the density reducing agent is selected from the group consisting of small, dispersed glass or plastic spheres or microballoons; a chemical foaming or gassing agent; and a combination of each.

8. A water-in-oil emulsion blasting composition comprising a water-immiscible liquid organic fuel as a continuous phase in an amount of from about 1% to about 10% by weight based on the total composition; an emulsified aqueous inorganic oxidizer salt solution comprising water in an amount from about 5% to about 20% and inorganic oxidizer salt in an amount from about 60% to about 94%; and an organic cationic emulsifier having a hydrophilic portion and lipophilic portion, wherein the lipophilic portion is an unsaturated hydrocarbon chain, in an amount from about 0.2% to about 5.0%.

9. A blasting composition according to claim 1 wherein the oxidizer salt solution contains additionally from about 1% to about 10% of a water-immiscible organic liquid fuel.

* * * * *